US008982003B2

(12) United States Patent
Taura

(10) Patent No.: US 8,982,003 B2
(45) Date of Patent: Mar. 17, 2015

(54) SLOT ANTENNA, ELECTRONIC APPARATUS, AND METHOD FOR MANUFACTURING SLOT ANTENNA

(75) Inventor: Toru Taura, Tokyo (JP)

(73) Assignee: NEC Corporation, Tokyo (JP)

( * ) Notice: Subject to any disclaimer, the term of this patent is extended or adjusted under 35 U.S.C. 154(b) by 706 days.

(21) Appl. No.: 13/148,904

(22) PCT Filed: Feb. 19, 2010

(86) PCT No.: PCT/JP2010/001084

§ 371 (c)(1),
(2), (4) Date: Aug. 10, 2011

(87) PCT Pub. No.: WO2010/116589

PCT Pub. Date: Oct. 14, 2010

(65) Prior Publication Data

US 2012/0007783 A1 Jan. 12, 2012

(30) Foreign Application Priority Data

Mar. 30, 2009 (JP) ..... 2009-081476

(51) Int. Cl.
*H01Q 1/24* (2006.01)
*H01Q 1/22* (2006.01)
*H01Q 13/10* (2006.01)

(52) U.S. Cl.
CPC ..... *H01Q 13/10* (2013.01); *H01Q 1/2266* (2013.01); *H01Q 1/243* (2013.01); *Y10T 29/49018* (2013.01)
USPC ..... 343/702; 343/700

(58) Field of Classification Search
USPC ..... 343/702, 700, 736, 803
See application file for complete search history.

(56) References Cited

U.S. PATENT DOCUMENTS 8,024,014 B2 * 9/2011 Boyle ..... 455/575.1
8,120,542 B2 * 2/2012 Shoji ..... 343/767

FOREIGN PATENT DOCUMENTS

| | | | |
|---|---|---|---|
| CN | 201194252 | Y | 2/2009 |
| JP | 5-110332 | A | 4/1993 |
| JP | 9-162634 | A | 6/1997 |
| JP | 2004048119 | A | 2/2004 |
| JP | 2004056421 | A | 2/2004 |
| JP | 2004104333 | A | 4/2004 |
| JP | 2006140735 | A | 8/2006 |

OTHER PUBLICATIONS

International Search Report for PCT/JP2010/001084 mailed May 25, 2010.
Chinese Office Action for CN Application No. 201080011428.6 issued on Jul. 22, 2013 with English Translation.

* cited by examiner

*Primary Examiner* — Karl D Frech
(74) *Attorney, Agent, or Firm* — Sughrue Mion, PLLC

(57) ABSTRACT

The present invention aims to provide a slot antenna, an electronic apparatus, and a method for manufacturing a slot antenna which are capable of obtaining multiple resonances with a small mounting space. The slot antenna according to the present invention includes three conductor plates: a rectangular conductor plate 10 having a notch with an open end formed at one side of the conductor plate; a rectangular conductor plate 20 disposed to face the conductor plate 10; a third conductor plate connecting the conductor plates 10 and 20 on a side opposite to the open end of the conductor plate 10; and a feeder 40 connecting a core wire 41 and a ground 42 at two points across the notch of the conductor plate 10.

10 Claims, 12 Drawing Sheets

SECTIONAL VIEW

SLOT ANTENNA, ELECTRONIC APPARATUS, AND METHOD FOR MANUFACTURING SLOT ANTENNA

TECHNICAL FIELD

The present invention relates to a slot antenna and an electronic apparatus, and more particularly, to a slot antenna having multi-resonance characteristics, an electronic apparatus including the slot antenna, and a method for manufacturing the slot antenna.

BACKGROUND ART

Along with the recent reduction in size and thickness of portable wireless terminals, some techniques using a case made of metal to ensure the rigidity of the terminals have been published.

Furthermore, along with the recent reduction in size and thickness of portable wireless terminals, the wireless functions mounted in the portable wireless terminals have been increased in number and increasingly sophisticated. This results in the necessity to mount a plurality of antennas in a small and thin metal case, while the distance between each antenna and the metal is extremely shortened due to limitations in mounting space of the antennas. Generally, if a metal is disposed near an antenna, the antenna characteristics are significantly degraded, which causes a problem that the antenna fails to function as a wireless terminal.

To solve such a problem, a technique is disclosed in which an elongated notch (slot) is formed in a metal case and the slot is allowed to operate as an antenna, as a technique for allowing an antenna to operate even when the antenna is disposed near a metal. A slot antenna typically has narrow-band characteristics. Accordingly, a technique for achieving a wide band by generating multiple resonances using a plurality of slots is well known.

Patent Literature 1 discloses an antenna apparatus having a plurality of slots formed therein to achieve multi-resonance characteristics. The antenna disclosed in Patent Literature 1 is composed of a notch antenna having a notch formed in a range from a substrate to an edge, and a parasitic notch antenna which is slightly shorter than the notch antenna and has a notch formed in parallel with the notch antenna.

In Patent Literature 2, two conductor plates are provided to face each other, and the conductor plates are connected together on one side thereof via another conductor plate. One of the two conductor plates has a gap portion (slit) with an open end formed at a side opposite to the side connected to another conductor plate. Capacitors C1 and C2 are disposed at locations sandwiching the gap portion, and are connected between the two conductor plates. The antenna disclosed in Patent Literature 2 achieves two resonances in regions on both sides of the gap portion of the conductor plate having the gap portion, and adjusts the resonances using the capacitors C1 and C2.

CITATION LIST

Patent Literature

[Patent Literature 1] Japanese Unexamined Patent Application Publication No. 2004-056421

[Patent Literature 2] Japanese Unexamined Patent Application Publication No. 09-162634

SUMMARY OF INVENTION

Technical Problem

However, the technique disclosed in Patent Literature 1 has a problem of an increase in mounting space of the antenna due to arrangement of a plurality of slots. The antenna disclosed in Patent Literature 1 has a structure in which one of the slots is allowed to operate by electromagnetic coupling. In this structure, the antenna characteristics greatly vary depending on the distance between two slots, which poses a problem of difficulty in adjusting the characteristics. Furthermore, the antenna disclosed in Patent Literature 2 has a microstrip antenna structure, and each slit disclosed in Patent Literature 2 does not operate as an antenna. Accordingly, in order to allow this structure to operate as an antenna, it is necessary to provide some space around the conductor plates forming the antenna element. Thus, there are such problems as an increase in mounting space of the antennas and difficulty in applying the antenna disclosed in Patent Literature 2 to a metal case.

In view of the above, the present invention has been made to solve the problems described above, and has an object to provide a slot antenna, an electronic apparatus, and a method for manufacturing a slot antenna which are capable of obtaining multiple resonances with a small mounting space.

Solution to Problem

A slot antenna according to a first aspect of the present invention includes: a first rectangular conductor plate having a notch with an open end formed at one side of the conductor plate; a second rectangular conductor plate disposed to face the first conductor plate; a third conductor plate that connects the first conductor plate and the second conductor plate on a side opposite to the open end; and a feeder that connects a core wire and a ground at two points across the notch.

An electronic apparatus according to a second aspect of the present invention includes: the slot antenna according to the first aspect; and a case that accommodates the slot antenna.

A method for manufacturing a slot antenna according to a third aspect of the present invention includes the steps of: forming a notch with an open end in one side of a conductor plate; and forming a slot antenna including a first conductor plate, a second conductor plate, and a third conductor plate, the first conductor plate being formed by processing the conductor plate to form the notch and providing a feeder connecting a core wire and a ground at two points across the notch, the second conductor plate being disposed to face the first conductor plate, the third conductor plate connecting the first conductor plate and the second conductor plate.

Advantageous Effects of Invention

According to the present invention, it is possible to provide a slot antenna, an electronic apparatus, and a method for manufacturing a slot antenna which are capable of obtaining multiple resonances with a small mounting space.

DESCRIPTION OF EMBODIMENTS

First Exemplary Embodiment

Figure 1:
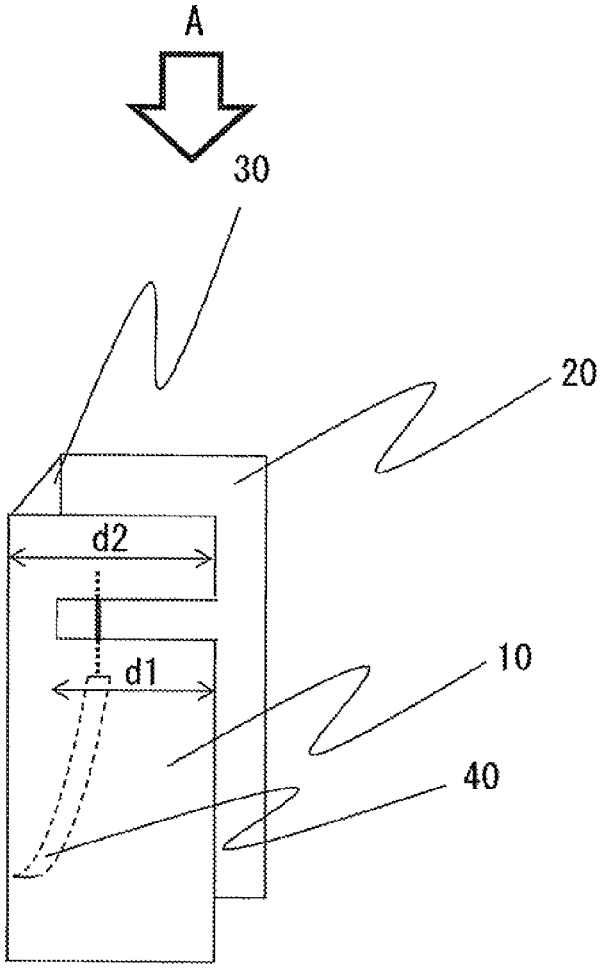
FIG. 1 is a schematic diagram of a slot antenna according to a first exemplary embodiment.
Figure 2:
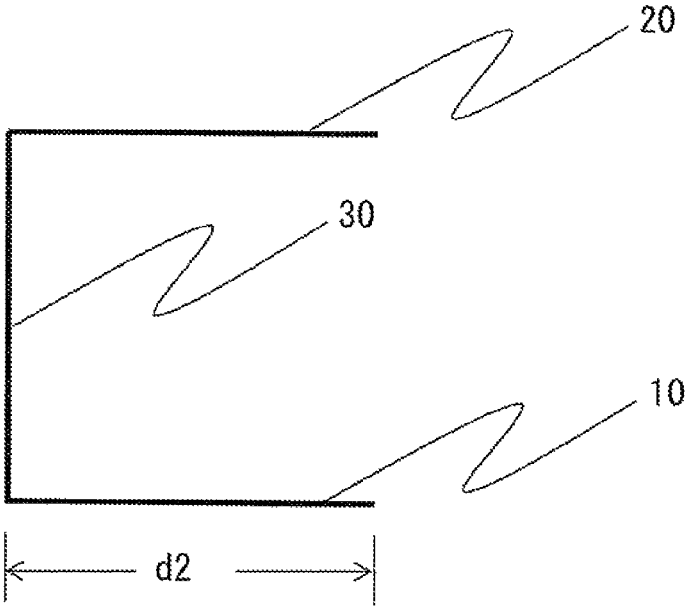
FIG. 2 is a schematic diagram of the slot antenna according to the first exemplary embodiment.

Exemplary embodiments of the present invention will be described below with reference to the drawings. FIG. 1 is a diagram showing a structure of a slot antenna according to a first exemplary embodiment of the present invention. FIG. 2 is a diagram of the slot antenna according to the first exemplary embodiment of the present invention, when viewed from the direction of the arrow "A" in FIG. 1. The slot antenna according to the first exemplary embodiment of the present invention includes conductor plates 10 to 30 and a feeder 40.

The conductor plate 10 is provided with the feeder 40 and has an elongated notch (hereinafter referred to as "slot"). The slot is formed on one side of the conductor plate 10 and has an open end. Assume herein that the width of the slot is sufficiently smaller than a length d1 of the slot and the length of one side of the conductor plate 10 in the same direction as the length of the slot is represented by d2.

A conductor plate 20 is disposed to face the conductor plate 10. Here, each of the conductor plate 10 and the conductor plate 20 has a given size. The first exemplary embodiment of the present invention is described assuming that the conductor plate 10 and the conductor plate 20 have the same size.

The conductor plate 30 is disposed so as to connect the conductor plate 10 and the conductor plate 20 on a side opposite to the side on which the open end of the slot is formed.

Figure 3:
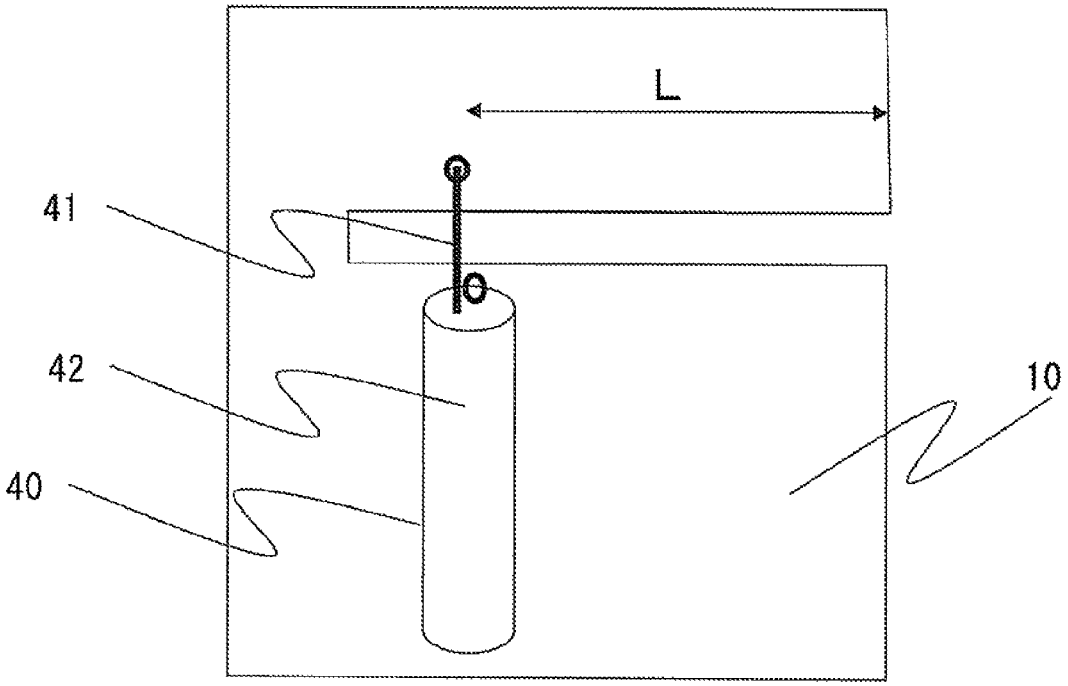
FIG. 3 is a connection diagram showing a feeder according to the first exemplary embodiment.

Next, the connection configuration of the feeder 40 will be described with reference to FIG. 3. The feeder 40 is formed of a coaxial cable having a characteristic impedance of 50Ω. A core wire 41 and a ground conductor 42 serving as an outer surface are soldered at two points so as to cross the slot. Assuming that the locations to be soldered correspond to a feed location, the feed location is represented by a distance L from the open end of the slot. It is desirable that the feed location L satisfy $Z0\times\cos^2(2\pi L/\lambda g)=50$. When the formula is satisfied, impedance matching can be achieved between the antenna and a RF circuit (not shown). Here, $Z0\approx487(\Omega)$ holds, where λg represents an electrical length corresponding to one wavelength of a frequency, one-quarter of the wavelength of which is equal to the length d1.

Next, operation of the slot antenna according to the first exemplary embodiment will be described. A current is excited around the slot through which power is supplied from the feeder 40, thereby generating a standing wave having a maximum electric field on the side of the open end of the slot and having a minimum electric filed on the side of the short-circuited end of the slot. The resonance frequency is a frequency, one-quarter of the wavelength of which is equal to the slot length d1. Another resonance is generated such that a current is excited along a U-shaped cavity structure formed of the conductor plates 10, 20, and 30, and a standing wave is generated so as to have a maximum electric field on the side of the open end of the U-shaped structure and a minimum electric field on the side where the conductor plate 30 is disposed. The resonance frequency is a frequency, one-quarter of the wavelength of which is equal to the distance d2 between the side of the conductor plate 10 on which the slot open end is formed and the conductor plate 30.

The resonance attributed to the slot corresponds to a resonance mode having an electric field component in the slot width direction. The resonance attributed to the cavity structure corresponds to a resonance mode having an electric field component in the direction of the space between the opposing conductor plates 10 and 20. The electric fields in the two resonance modes are orthogonal to each other, and the both modes do not interfere with each other. This provides an advantage that the resonance frequencies can be individually adjusted and the adjustment operation can be finished in a short period of time.

Now, the arrangement of the conductor plates 10 to 30 will be described in detail. The conductor plate 10 and the conductor plate 20 may be arranged substantially in parallel with each other. The term "substantially" is used because a strictly parallel state is not required for formation of an actual antenna. The conductor plates 10 and 20 described above have the same size, but the size of the conductor plates is not limited to this. The conductor plate 10 may be larger than the conductor plate 20. As for the positional relationship between the side on which the open end of the slot antenna is formed and the side of the conductor plate 20, the side on which the slot open end is formed is desirably flush with or projects outside the side of the conductor plate 20.

Though the conductor plate 30 has a plate-like structure as shown in FIG. 1, the structure of the conductor plate 30 is not limited to this. The conductor plate 30 may be made of an elastic conductive material such as gasket, and may be structured to render the conductor plates 10 and 20 electrically conductive. Alternatively, the conductor plate 30 may have a structure in which multiple elongated rod-like metal pieces are discretely disposed at a plurality of locations to connect the conductor plates 10 and 20. In this case, the interval between the connected conductor plates is desirably equal to or smaller than one-tenth of a wavelength corresponding to the resonance frequency. The conductor plates 10 and 20 may be connected by soldering elongated rod-like metals onto both the conductor plates. Alternatively, the conductor plates 10 and 20 may be rendered electrically conductive by causing an elastic material, such as a plate spring, to be pressed against the conductor plates. The conductor plate 30 is preferably disposed in at least a range from the upper end of a long side of one of the conductor plates 10 and 20 to the position where the slot is formed so that the conductor plates 10 and 20 can be rendered electrically conductive.

As shown in FIG. 1, the conductor plate 30 is connected to a long side of each of the rectangular conductor plates 10 and 20, but may be connected to an inside surface portion of each of the conductor plates 10 and 20.

Figure 4:
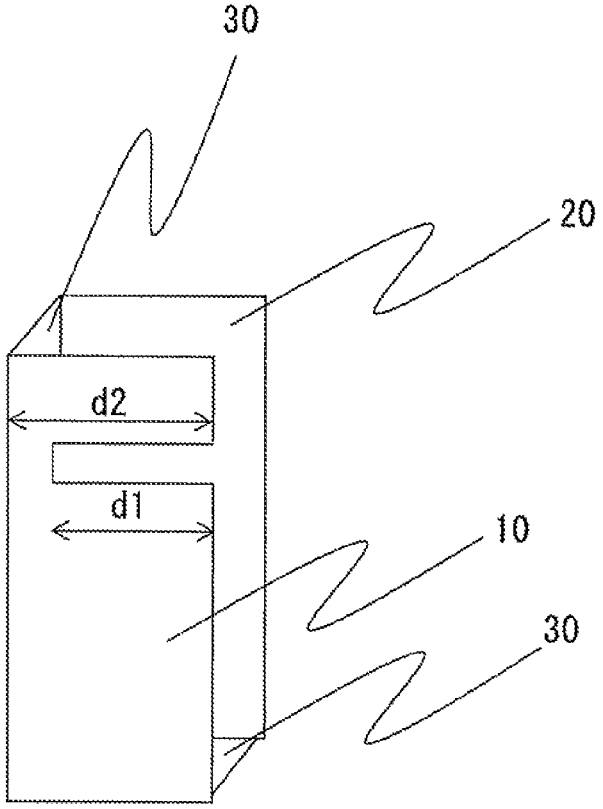
FIG. 4 is a schematic diagram of the slot antenna according to the first exemplary embodiment.

Furthermore, as shown in FIG. 4, the conductor plate 30 may have an L-shape and may be disposed so as to be connected to a long side and a short side of each of the conductor plates 10 and 20.

Figure 5:
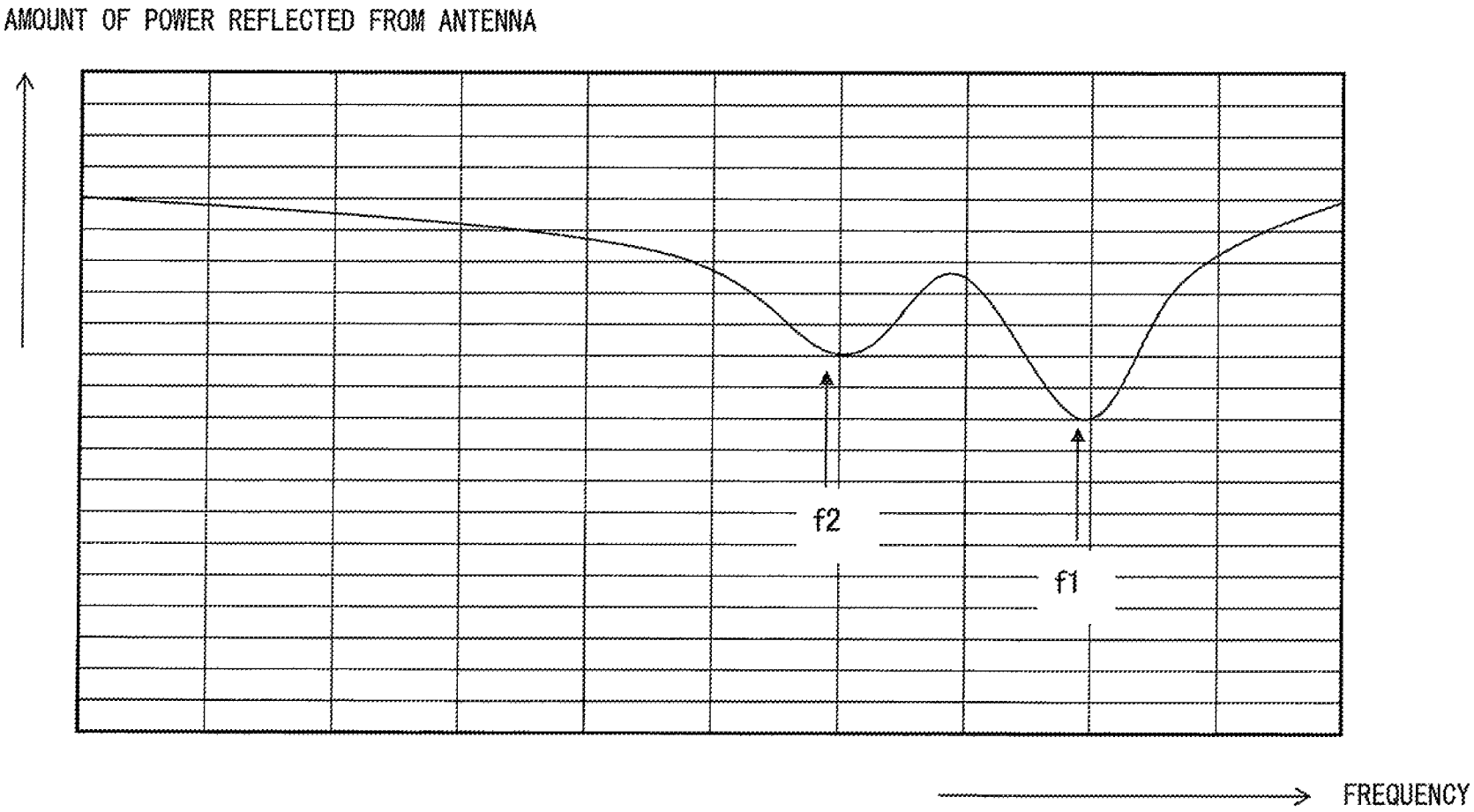
FIG. 5 is a diagram showing input impedance characteristics according to the first exemplary embodiment.

FIG. 5 shows input impedance characteristics of the slot antenna according to the first exemplary embodiment of the present invention. The axis of ordinate represents the amount of power reflected from the antenna, and the axis of abscissa represents a frequency. Assume herein that the bottom of the valley of the characteristic curve shown in the figure indicates a resonance frequency of the antenna. In the antenna structure shown in FIG. 1, the relationship between the length d1 of the slot and the length d2 of the cavity structure is expressed as d1<d2. Accordingly, a resonance frequency f2 on the low frequency side is determined by the length d2 of the cavity structure, and a resonance frequency f1 on the high frequency side is determined by the length d1 of the slot.

As described above, the use of the slot antenna according to the first exemplary embodiment of the present invention enables generation of resonance attributed to the operation of the slot portion and resonance attributed to the operation of the cavity structure formed of the conductor plates 10 to 30, thereby achieving multiple resonances. The antenna of the present invention has a simple structure in which the cavity structure has only one slot, thereby achieving a multi-resonant antenna with a small mounting space. Furthermore, the two resonance modes obtained with the antenna structure according to the present invention do not interfere with each other, which is advantageous in facilitating the adjustment of the resonance frequencies.

Moreover, the conductor plate 30 is formed into an L-shape and is disposed so as to be connected to a long side and a short side of each of the conductor plates 10 and 20. This structure serves as a shielding wall for reducing the electromagnetic interference between the antenna and various circuits, thereby ensuring excellent antenna operation and excellent operation of peripheral devices and various circuits.

Second Exemplary Embodiment

Figure 6:
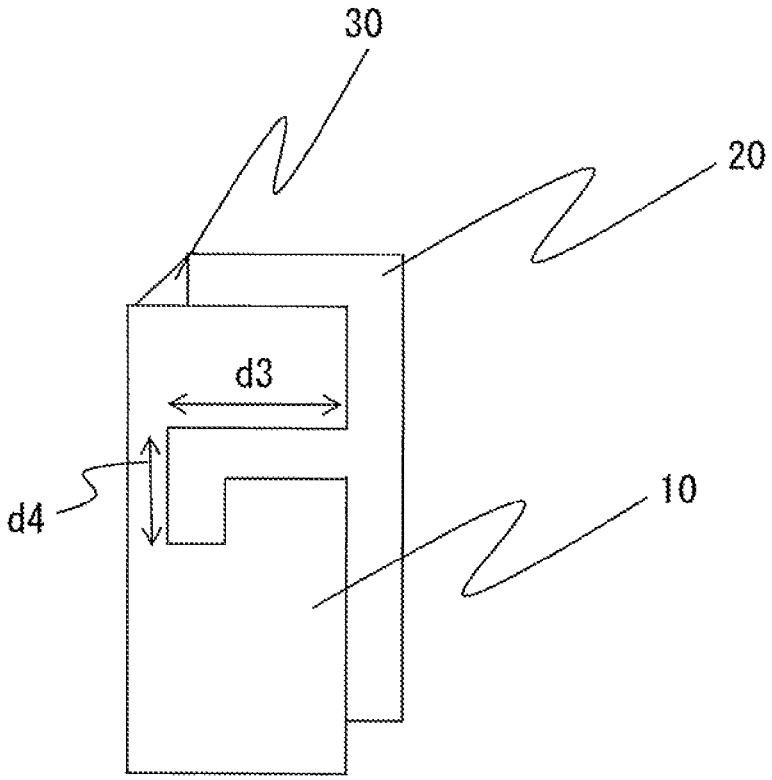
FIG. 6 is a schematic diagram of a slot antenna according to a second exemplary embodiment.

Referring next to FIG. 6, a structure of a slot antenna according to a second exemplary embodiment of the present invention will be described. The feeder 40 is similar to that shown in FIG. 1, so the description thereof is omitted. The slot antenna according to the second exemplary embodiment of the present invention has a feature that a slot is bent at an angle of 90 degrees into an L-shape. The other components are similar to those of the first exemplary embodiment. Assume that the length of a notch extending in the direction of the conductor plate 30 from an open end is represented by d3 and the length of the notch extending in parallel with the conductor plate 30 is represented by d4. In this case, resonance is generated at a frequency, one-quarter of the wavelength of which is equal to the distance represented by d3+d4. Another resonance is generated such that a current is excited along a U-shaped cavity structure formed of the conductor plates 10, 20, and 30, and a standing wave is generated so as to have a maximum electric field on the side of the open end of the U-shaped structure and a minimum electric field on the side where the conductor plate 30 is disposed. The resonance frequency is a frequency, one-quarter of the wavelength of which is equal to the distance d2 between the side of the conductor plate 10 on which the slot open end is formed and the conductor plate 30.

As described above, the use of the slot antenna according to the second exemplary embodiment of the present invention enables generation of resonance attributed to the operation of the slot portion and resonance attributed to the operation of the cavity structure formed of the conductor plates 10 to 30, thereby achieving multiple resonances. Moreover, one of the two resonances, which is attributed to the slot, has a low frequency because the length of the slot can be increased.

Third Exemplary Embodiment

Figure 7:
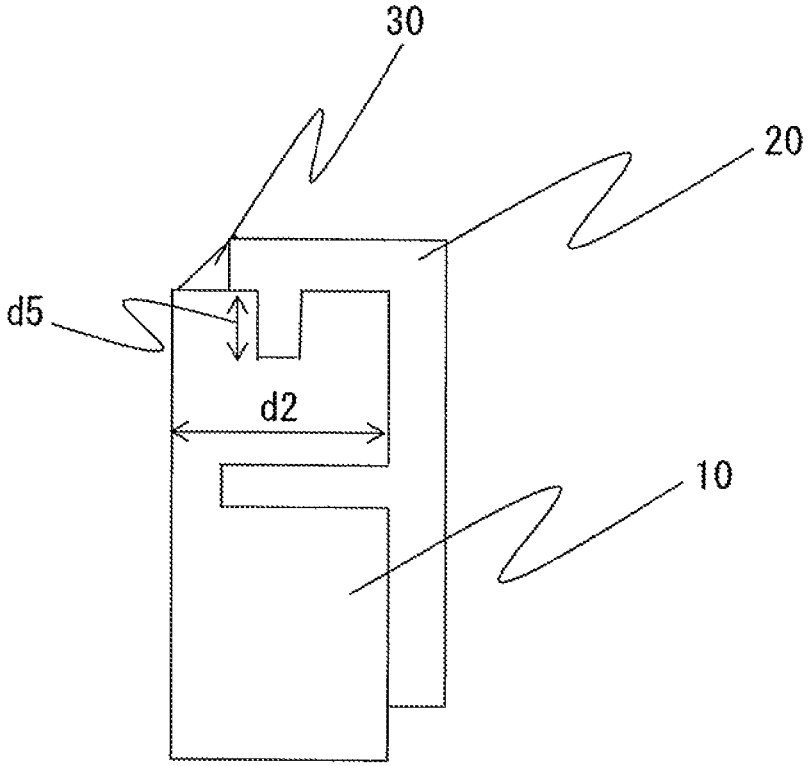
FIG. 7 is a schematic diagram of a slot antenna according to a third exemplary embodiment.

Referring next to FIG. 7, a structure of a slot antenna according to a third exemplary embodiment of the present invention will be described. The feeder 40 is similar to that shown in FIG. 1, so the description thereof is omitted. The slot antenna according to the third exemplary embodiment of the present invention has a feature that another notch with an open end is formed at a side near the notch other than one side connected to the third conductor plate and one side having the open end. The newly formed slot is used to adjust the length d2. That is, when a length d5 of the notch is taken into consideration, the distance d2 is expressed as d2+2×d5. As a result, resonance is generated at a frequency, one-quarter of the wavelength of which is equal to the distance represented by d2+2×d5.

As described above, the use of the slot antenna according to the third exemplary embodiment of the present invention enables arbitrary adjustment of the resonance frequency obtained with the structure formed of the conductor plates 10 to 30, through adjustment of the dimensions using the newly provided notch, without affecting the resonance attributed to the slot. In the case where the antenna structure of this exemplary embodiment is applied to an electronic apparatus, metal components constituting an electronic apparatus, such as a frame made of metal and a metal plate for strength retention, may be used in combination with the antenna. If the design change occurs in positions or the like of these metal components used in combination with the antenna, the resonance frequency of the antenna also greatly varies depending on the apparatus design and mounting conditions. As a result, a desired resonance frequency cannot be obtained. On the other hand, the use of the notch as in this exemplary embodiment provides an advantage that the position and length of the notch is appropriately adjusted according to the design change of the electronic apparatus, thereby easily obtaining a desired resonance frequency.

Fourth Exemplary Embodiment

Figure 8:
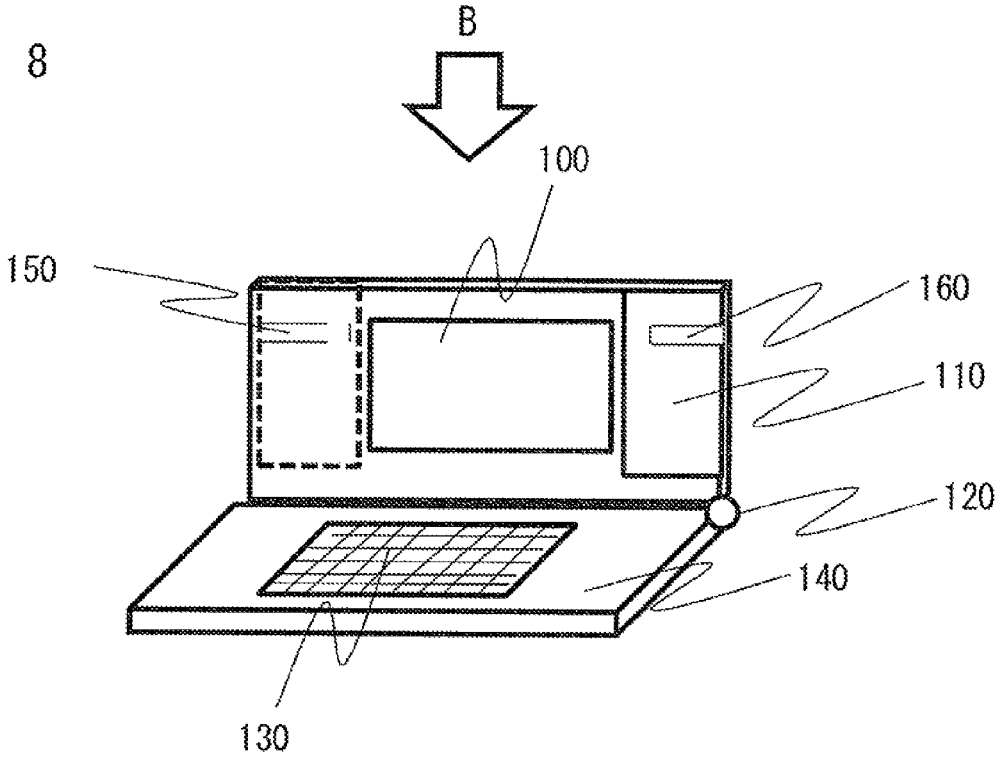
FIG. 8 is a schematic diagram of an electronic apparatus according to a fourth exemplary embodiment.

Referring next to FIG. 8, a structure of an electronic apparatus according to a fourth exemplary embodiment of the present invention will be described. The electronic apparatus according to the fourth exemplary embodiment of the present invention includes a display portion 100; a display case 110 which is made of metal and includes a frame extending around the display portion 100; a main body case 140 which is made of metal and includes a key input portion 130; a hinge portion 120 that allows rotational operation in the direction in which the display case 110 and the main body case 140 face each other; and slot antennas 150 and 160 which are respectively disposed on the right and left sides of the display case 110.

The slot antennas 150 and 160 each are formed in a mode according to any one of the first to third exemplary embodiments described above. The slot antennas 150 and 160 may be formed in the same mode or in different modes, or may be formed in a mode corresponding to a combination of the first to third exemplary embodiments. The conductor plates 10 to 30, which are the components of the slot antenna of the present invention, may be incorporated into an electronic apparatus as the components of the slot antenna. Alternatively, the conductor plates 10 to 30 may be used in combination with metal components of the electronic apparatus. For example, a metal frame for holding a liquid crystal display (LCD) may also be used as the conductor plate 30. As another example, a top plate made of metal for retaining the strength of the display case may also be used as the conductor plate 10 or 20.

The slot antennas 150 and 160 may be included not in the display case 110 but in the main body case 140, or may be included in both the display case 110 and the main body case 140.

The hinge portion 120 also allows an operation for arranging the display case 110 and the main body case 140 in contact with each other so that the display portion 100 and the key input portion 130 face each other. Furthermore, the hinge portion 120 allows an operation for arranging the surface of the display case 110 on which the display portion 100 is not formed, i.e., the rear surface of the display case 110, in contact with the key input portion 130, thereby enabling the display case 110 to be opened in a so-called tablet style.

When the slot antenna is included in the display case 110 made of metal, the slot antenna provided in the display case 110 is supplied with power from a RF circuit (not shown) and is excited and resonated at a frequency, one-quarter of the wavelength of which is equal to the length of the slot. The structure formed of the conductor plates 10 to 30 constituting the slot antenna generates resonance at a frequency, one-quarter of the wavelength of which is equal to the distance d2. These currents exited by the antenna flow through the antenna and the entire metal case, and the metal case itself serves as a radiation conductor so that the currents act as a radiation source. The radiation pattern has a directivity on the side where the slot is disposed. A combination of a plurality of slot antennas obtained by changing the directivity of each antenna are mounted on an apparatus, which makes it possible to form an antenna having a directivity in a given direction.

Figure 9:
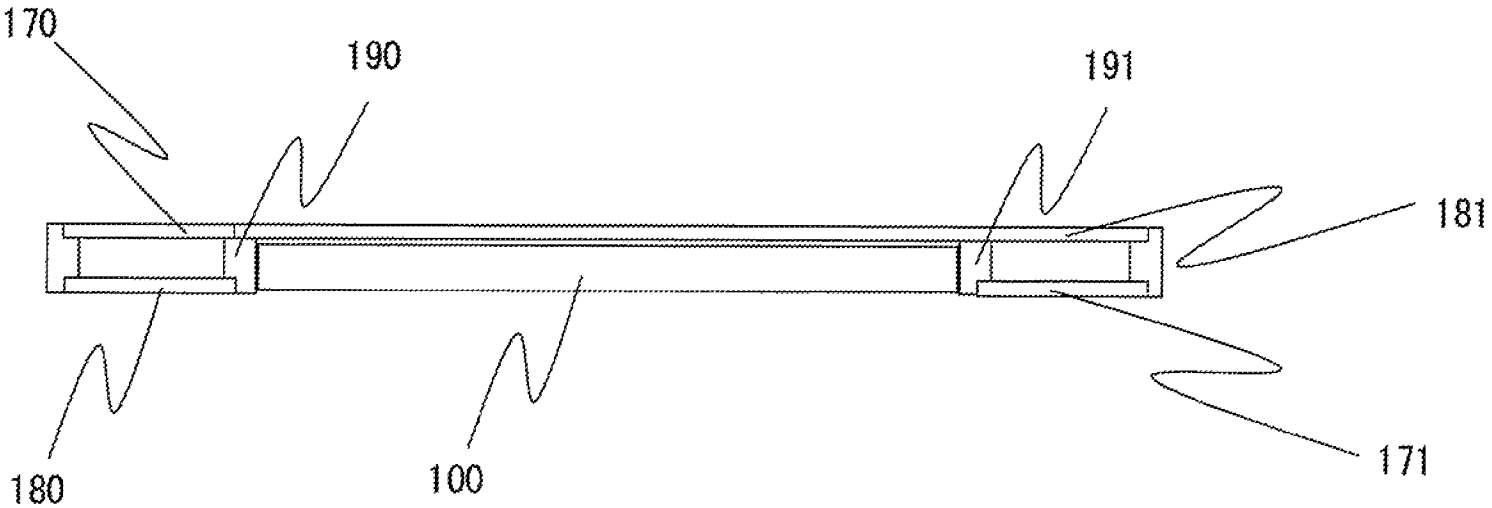
FIG. 9 is a schematic diagram of the electronic apparatus according to the fourth exemplary embodiment.

Referring next to FIG. 9, a schematic diagram of the display case 110 when viewed from the direction of "B" in FIG. 8 will be described. The display case 110 includes the display portion 100; metal plates 170 and 171 each including a slot; metal plates 180 and 181; and frames 190 and 191. The metal plates 170 and 171 each correspond to the conductor plate 10 shown in FIG. 1. The metal plates 180 and 181 each correspond to the conductor plate 20 shown in FIG. 1. The frames 190 and 191 each correspond to the conductor plate 30 shown in FIG. 1.

The metal plates 170 and 180 are disposed to face each other and the frame 190 is connected therebetween. Similarly, the metal plates 171 and 181 are disposed to face each other and the frame 191 is connected therebetween. The metal plate 171 having a slot is disposed on the surface on which the display portion 100 is formed. The metal plate 170 having a slot is disposed on the rear surface side of the display portion 100. The metal plates 170 and 171 are respectively disposed on the right and left sides of the display portion 100.

When the display case 110 is opened in a tablet style, the metal plate 171 having a slot operates so that the opposing metal plate 181 blocks the effect of the metal in the main body case 140. Thus, the metal plate 171 having a slot can operate without being affected by the metal in the main body case 140.

When the display portion 100 of the display case 110 is closed for storage, i.e., when the display portion 100 is closed so that the display portion 100 and the key input unit 130 face each other, the metal plate 170 having a slot operates so that the opposing metal plate 180 blocks the effect of the metal in the main body case 140. Thus, the metal plate 170 having a slot can operate without being affected by the metal in the main body case 140.

A newly generated resonance circuit which is formed of the metal plate 170, the metal plate 180, and the frame 190, or formed of the metal plate 171, the metal plate 181, and the frame 191 is not affected by the metal in the main body case 140 even when the display case is opened or closed, or opened in a tablet style. This is because the shape shown in FIG. 2 is maintained even when the metal in the main body case 140 and the metal in the display case 110 overlap each other. Accordingly, in the electronic apparatus according to this exemplary embodiment, the antenna operates also when the display case is in any state, such as, opened, closed, or opened in a tablet style, thereby preventing the wireless functions from being impaired.

The slots of the metal plates 170 and 171, which are respectively disposed on the right and left sides of the display portion 100, are formed to have the same dimensions and the same shape, for example, to obtain the same characteristics. This allows the electronic apparatus to comply with high-speed, large-capacity wireless communication such as MIMO (Multiple Input Multiple Output) for transmitting and receiving data with a plurality of antennas. The dimensions, shape, and the like of the slots of the metal plates 170 and 171, which are respectively disposed on the right and left sides of the display portion 100, may be set to be different from each other to attain antennas having different characteristics, which allows the electronic apparatus to comply with a plurality of wireless frequency bands.

As described above, the use of the electronic apparatus according to the fourth exemplary embodiment of the present invention enables communication compliant with a plurality of wireless frequency bands without impairing the wireless functions also in the electronic apparatus including the display case 110 which is provided with slot antennas and changes in various directions. The fourth exemplary embodiment of the present invention has described the structure in which one of the metal plates each having a slot is disposed on the side of the display portion 100 and the other metal plate is disposed on the rear surface side thereof. Alternatively, the metal plates each having a slot may be disposed only on the side of the display portion 100, or may be disposed only on the rear surface side thereof. More alternatively, a single metal plate may be disposed on either the side of the display portion 100 or the rear surface side thereof.

Fifth Exemplary Embodiment

Figure 10A:
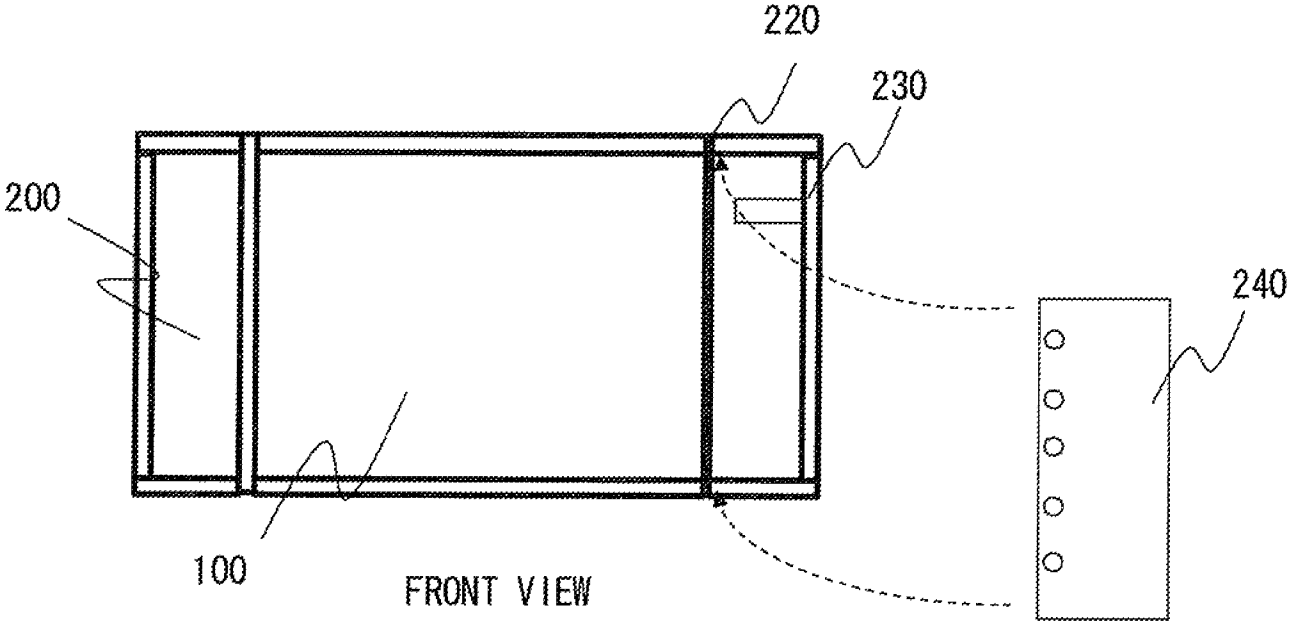
FIG. 10A is a diagram showing a method for assembling an electronic apparatus according to a fifth exemplary embodiment.
Figure 10B:
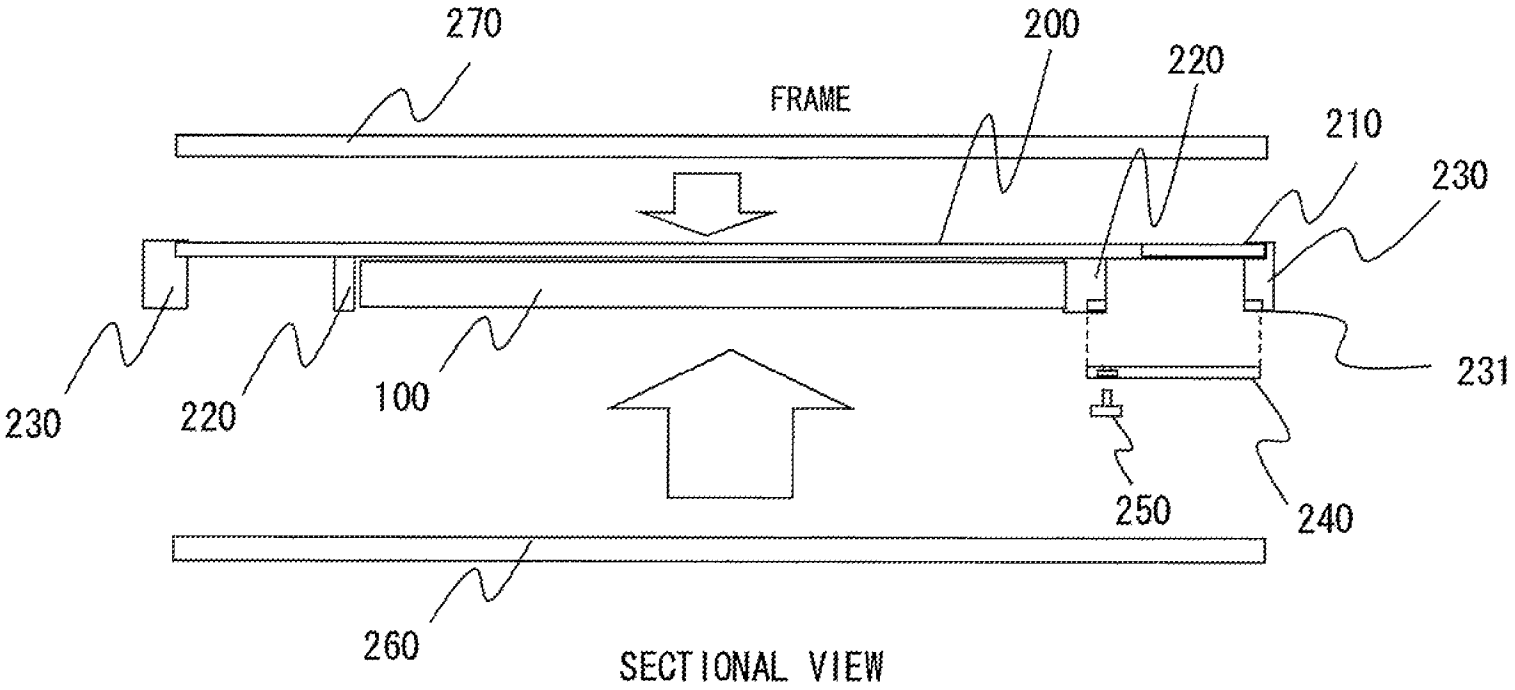
FIG. 10B is a diagram showing a method for assembling the electronic apparatus according to the fifth exemplary embodiment.
Figure 11A:
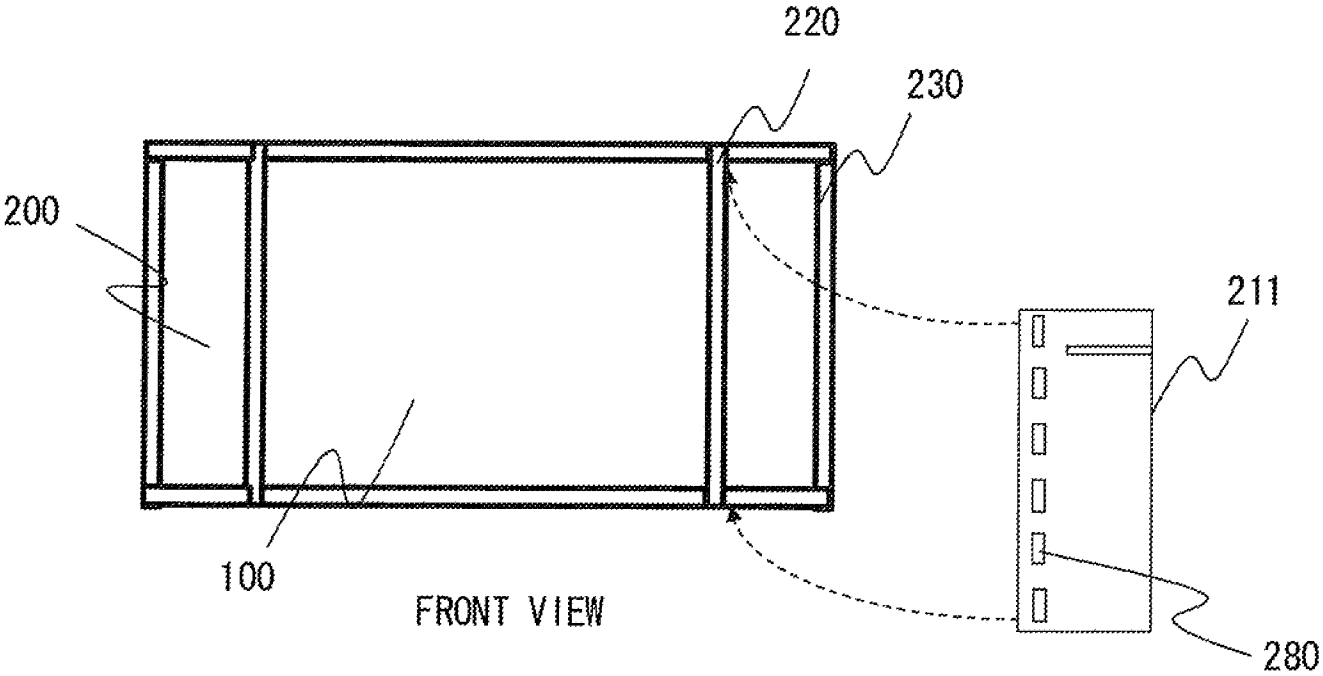
FIG. 11A is a diagram showing a method for assembling the electronic apparatus according to the fifth exemplary embodiment.
Figure 11B:
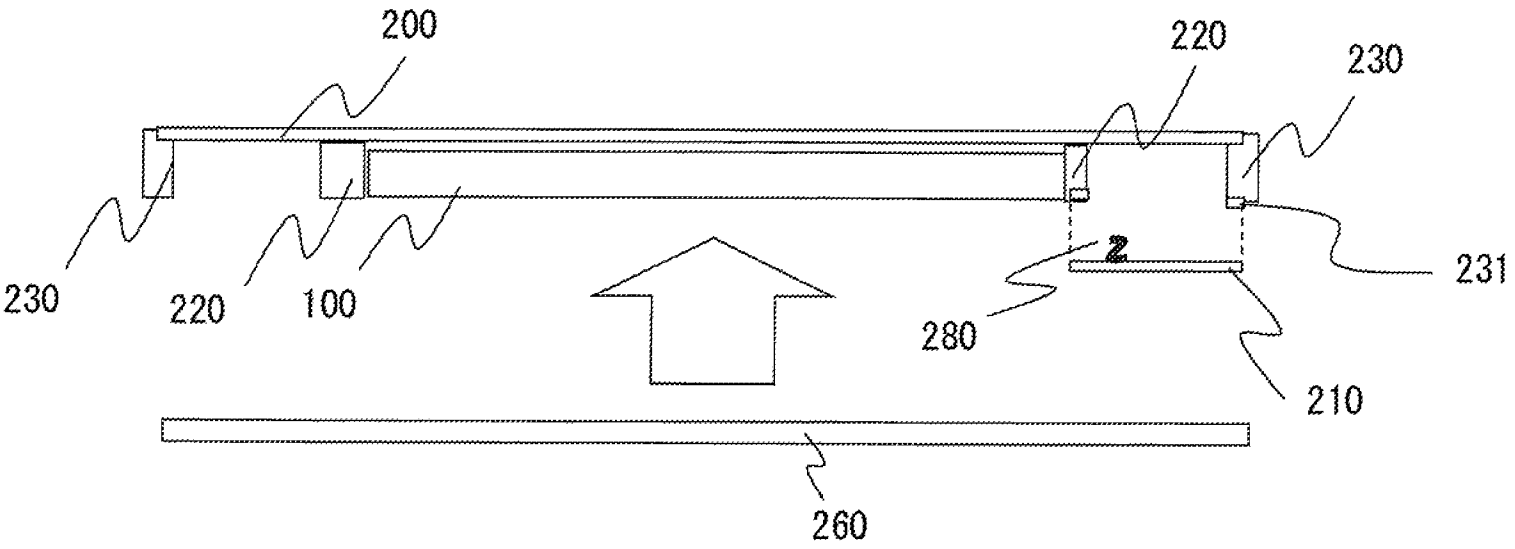
FIG. 11B is a diagram showing a method for assembling the electronic apparatus according to the fifth exemplary embodiment.
Figure 12A:
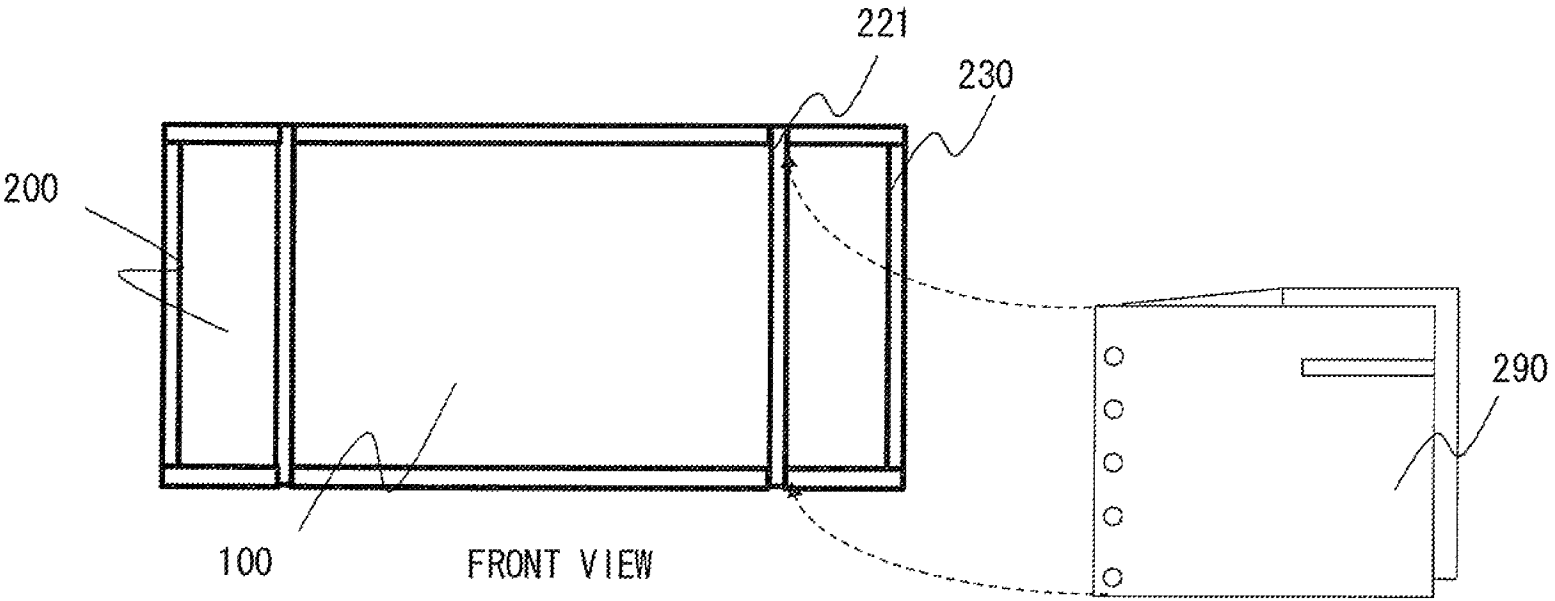
FIG. 12A is a diagram showing a method for assembling the electronic apparatus according to the fifth exemplary, embodiment.
Figure 12B:
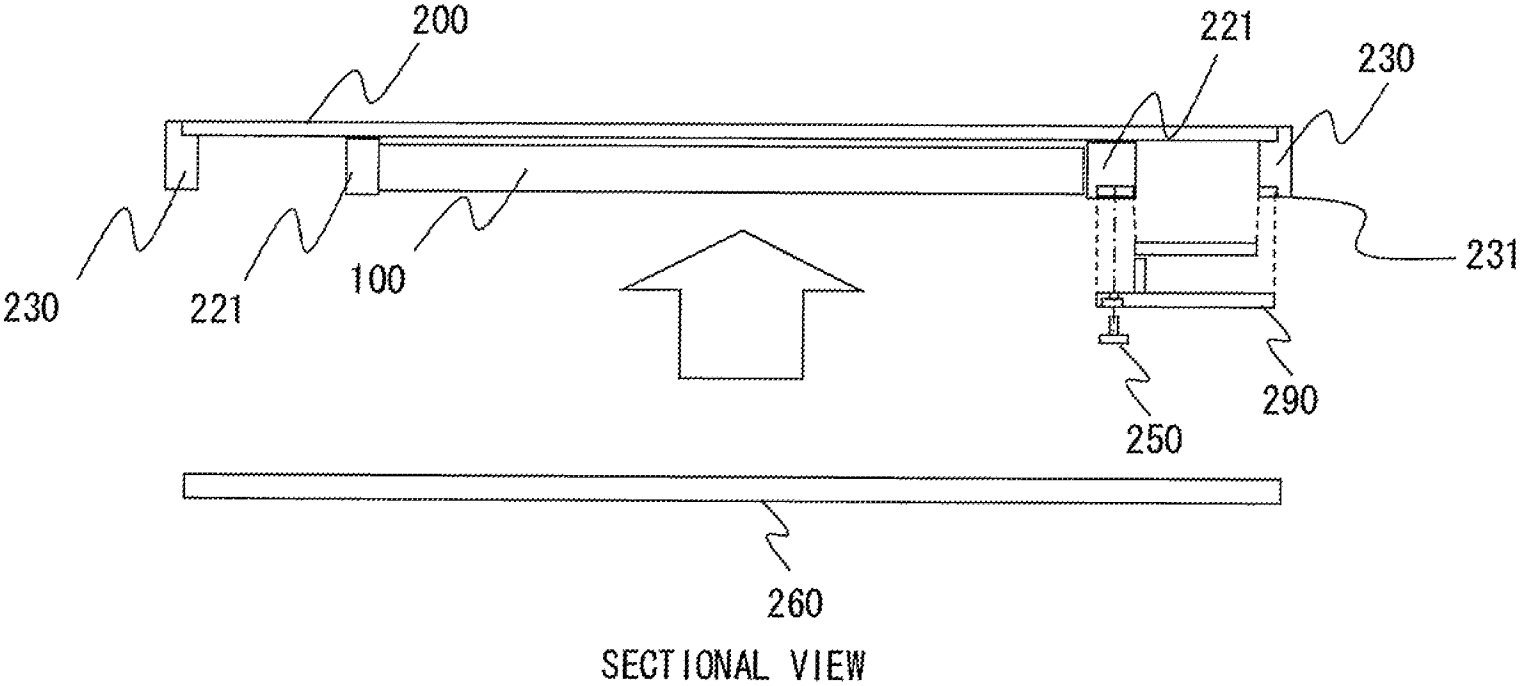
FIG. 12B is a diagram showing a method for assembling the electronic apparatus according to the fifth exemplary embodiment.

Referring next to FIGS. 10 to 12, a method for assembling an electronic apparatus according to a fifth exemplary embodiment of the present invention will be described. FIGS. 10A and 10B each show an assembling method when a slot 210 is directly formed in a top plate 200 of the display case 110 which is a metal case. FIG. 10A is a schematic diagram when viewed from the front of the display case 110, and FIG. 10B is a sectional view of the display case when viewed from the top (viewed from the direction of "B" in FIG. 8). The same holds true for FIGS. 11A and 11B and FIGS. 12A and 12B.

First, a metal frame 220 made of metal is mounted to the top plate 200, which is made of metal and provided with the elongated slot 210, and a frame 230 made of resin is mounted to an outer peripheral portion of the top plate 200.

Next, a metal plate 240 is disposed to face the slot 210. The metal plate 240 is positioned along a mounting guide 231 and is screwed into the metal frame 220 with a screw 250 via a screw hole of the metal plate 240.

Then, a protective panel 260 for protecting the display portion 100 is attached onto each of the metal plate 240 and the display portion 100, and a decorative laminate 270 made of resin is disposed on the top plate 200 made of metal so as to cover the slot 210.

FIGS. 11A and 11B each show an example of the assembling method when a slot is disposed on the side of the display portion.

First, the metal frame 220 made of metal is mounted to the top plate 200 made of metal, and the frame 230 made of resin is mounted to an outer peripheral portion of the top plate 200.

Next, a metal plate (slot antenna module) 211 having a slot formed therein to face the top plate 200 is disposed by being positioned along the mounting guide 231. A contact 280, such as a plate spring or a spring pin, may be used so that the slot antenna module 211 and the top plate 200 made of metal are rendered electrically conductive. The slot antenna module 211 may be mounted with a screw as shown in FIG. 10B.

Next, the protective panel 260 for protecting the display portion 100 is attached onto the slot antenna module 211 having a slot formed therein.

FIGS. 12A and B each show an exemplary method for incorporating a slot antenna into the display case 110 made of resin. A slot antenna module 290, which is obtained by bending a metal plate with a slot into the shape shown in FIG. 1, is positioned along a mounting guide 221 and is screwed into frames 221 and 230 made of resin. The other assembly methods are similar to those shown in FIGS. 10A and 11B and FIGS. 11A and 11B.

Note that the present invention is not limited to the above exemplary embodiments, but can be modified as appropriate without departing from the scope of the present invention.

The present invention has been described above with reference to exemplary embodiments, but the present invention is not limited to the above exemplary embodiments. The structure and details of the present invention can be modified in various manners which can be understood by those skilled in the art within the scope of the present invention.

This application is based upon and claims the benefit of priority from Japanese patent application No. 2009-081476, filed on Mar. 30, 2009, the disclosure of which is incorporated herein in its entirety by reference.

REFERENCE SIGNS LIST

10, 20, 30 CONDUCTOR PLATE
100 DISPLAY PORTION
110 DISPLAY CASE
120 HINGE PORTION
130 KEY INPUT PORTION
140 MAIN BODY CASE
150, 160 SLOT ANTENNA
170, 171, 180, 181 METAL PLATE
190, 191 FRAME
200 TOP PLATE
210 SLOT
211 SLOT ANTENNA MODULE
220 METAL FRAME
221 RESIN FRAME
230 RESIN FRAME
231 MOUNTING GUIDE
240 METAL PLATE
250 SCREW
260 PROTECTIVE PANEL
270 DECORATIVE LAMINATE
280 SPRING
290 SLOT ANTENNA MODULE

The invention claimed is:

1. A slot antenna comprising:
a first rectangular conductor plate having a notch with an open end formed at one side of the conductor plate;
a second rectangular conductor plate disposed to face the first conductor plate;
a third conductor plate that connects the first conductor plate and the second conductor plate on a side opposite to the open end of the notch; and
a feeder that connects a core wire and a ground at two points across the notch.

2. The slot antenna according to claim 1, wherein the notch is formed near an end of a long side of the first conductor plate.

3. The slot antenna according to claim 1, wherein
the notch formed in the first conductor plate has a length equal to one-fourth of a wavelength corresponding to a center frequency of a first frequency band, and
a short side of the first conductor plate has a length equal to one-fourth of a wavelength corresponding to a center frequency of a second frequency band.

4. The slot antenna according to claim 1, wherein the notch formed in the first conductor plate has an L-shape.

5. The slot antenna according to claim 1, wherein the first conductor plate has another notch with an open end formed at a side near the notch other than one side connected to the third conductor plate and one side having the open end.

6. An electronic apparatus comprising:
a slot antenna according to claim 1; and
a case that accommodates the slot antenna.

7. The electronic apparatus according to claim 6, wherein the case accommodates M (M is an integer equal to or greater than 2) number of the slot antennas, and a notch of at least one slot antenna and a notch of another slot antenna are formed on different planes.

8. The electronic apparatus according to claim 6, wherein the case accommodates M (M is an integer equal to or greater than 2) number of the slot antennas, and notches of the M number of slot antennas are formed on the same plane.

9. The electronic apparatus according to claim 6, further comprising a display portion including a display screen,
wherein the slot antenna is disposed around the display portion.

10. A method for manufacturing a slot antenna, comprising the steps of:
forming a notch with an open end in one side of a conductor plate; and
forming a slot antenna including a first conductor plate, a second conductor plate, and a third conductor plate, the first conductor plate being formed by processing the conductor plate to form the notch and providing a feeder connecting a core wire and a ground at two points across the notch, the second conductor plate being disposed to face the first conductor plate, the third conductor plate connecting the first conductor plate and the second conductor plate.

* * * * *